US007581543B2

(12) United States Patent
McGrath et al.

(10) Patent No.: US 7,581,543 B2
(45) Date of Patent: Sep. 1, 2009

(54) REDUCTION OF PHENOLIC COMPOUND PRECURSORS IN TOBACCO

(75) Inventors: Thomas E. McGrath, Richmond, VA (US); Naren K. Meruva, Richmond, VA (US); W. Geoffrey Chan, Chesterfield, VA (US); Marc R. Krauss, Midlothian, VA (US); Darin Colassaco, Newport News, VA (US)

(73) Assignee: Philip Morris USA Inc., Richmond, VA (US)

( * ) Notice: Subject to any disclaimer, the term of this patent is extended or adjusted under 35 U.S.C. 154(b) by 461 days.

(21) Appl. No.: 11/104,636

(22) Filed: Apr. 13, 2005

(65) Prior Publication Data

US 2005/0279374 A1 Dec. 22, 2005

Related U.S. Application Data

(60) Provisional application No. 60/561,885, filed on Apr. 14, 2004.

(51) Int. Cl.
*A24D 1/00* (2006.01)

(52) U.S. Cl. ..... 131/364

(58) Field of Classification Search ..... 131/143, 131/297, 298, 308, 309
See application file for complete search history.

(56) References Cited

U.S. PATENT DOCUMENTS 2,818,073 A * 12/1957 Taylor ..... 131/334
3,561,451 A 2/1971 Norwalk et al.
4,056,108 A * 11/1977 Schumacher et al. ..... 131/278
4,200,113 A 4/1980 Schmidt
4,202,356 A * 5/1980 Digenis et al. ..... 131/332
4,343,317 A 8/1982 Bokelman
4,407,307 A 10/1983 Gaisch et al.
4,516,590 A 5/1985 Teng et al.

(Continued)

FOREIGN PATENT DOCUMENTS

WO 93/02187 A1 2/1993

OTHER PUBLICATIONS

Provisional Technical Information Divergan® HM, Apr. 1996. pp. 1-3.*

(Continued)

*Primary Examiner*—Steven P Griffin
*Assistant Examiner*—Jodi Cohen
(74) *Attorney, Agent, or Firm*—Buchanan Ingersoll & Rooney PC

(57) ABSTRACT

A tobacco rod having reduced levels of at least one phenolic compound precursor selected from the group consisting of gentisic acid, 3,4-dihydroxybenzoic acid, chlorogenic acid, rutin, scopoletin, quinic acid, a quinic acid derivative, caffeic acid, inositol and lignin. The concentration in mainstream smoke of phenolic compounds such as phenol, hydroquinones (e.g., hydroquinone, methyl hydroquinone and 2,3-dimethyl hydroquinone), catechols (e.g., p-coumaryl quinic acid, feruloyl quinic acid and syringoyl quinic acid) and cresols (e.g., o-cresol, m-cresol and p-cresol) can be reduced by reducing the concentration in uncured (e.g., green) or cured tobacco of the phenolic compound precursors. The concentration of phenolic compound precursors in tobacco can be reduced by forming an extract of tobacco solubles, removing phenolic compound precursors from the extract by treating the extract with polyvinylpolypyrrolidone or polyvinylimidazole in the absence of an enzyme to form a treated extract; and restoring the treated extract to the tobacco.

14 Claims, 1 Drawing Sheet

U.S. PATENT DOCUMENTS

| | | | | |
|---|---|---|---|---|
| 4,887,618 | A | 12/1989 | Bernasek et al. | |
| 4,992,178 | A * | 2/1991 | Chaufer et al. | 210/651 |
| 5,008,339 | A * | 4/1991 | Anson et al. | 525/181 |
| 5,150,724 | A | 9/1992 | Liu | |
| 5,311,886 | A * | 5/1994 | De Grandpre et al. | 131/297 |
| 5,360,022 | A | 11/1994 | Newton et al. | |
| 5,527,548 | A * | 6/1996 | Tyortyalian | 426/72 |
| 5,601,097 | A | 2/1997 | De Grandpre et al. | |
| 5,744,183 | A * | 4/1998 | Ellsworth et al. | 426/330.4 |
| 5,776,879 | A * | 7/1998 | Shih et al. | 510/361 |
| 6,298,859 | B1 * | 10/2001 | Kierulff et al. | 131/297 |
| 6,620,602 | B2 | 9/2003 | Frost et al. | |
| 6,782,891 | B2 | 8/2004 | Chatterjee | |
| 6,789,548 | B2 | 9/2004 | Bereman | |
| 2003/0000538 | A1 * | 1/2003 | Bereman | 131/352 |
| 2003/0106562 | A1 | 6/2003 | Chatterjee | |
| 2003/0111087 | A1 | 6/2003 | Chatterjee | |
| 2003/0150011 | A1 | 8/2003 | Grotewold et al. | |
| 2004/0045565 | A1 | 3/2004 | Mua et al. | |
| 2004/0045566 | A1 | 3/2004 | Pera | |

OTHER PUBLICATIONS

Divergan® F, Products for the Dietary Supplement, Beverage and Food Industries—Technical Information May 2005, BASF The Chemical Company.*

Divergan® , Technical Information, BASF The Chemical Company, Undated.*

Flebbe, Thomas et al. Modeling of polyvinylpyrriolidone and polyvinylimidazole in aqueous solution, Macromolecular Theory and Simulations vol. 7, No. ,. pp. 567-577. Copyright Wiley-vch Verlag GimbH 1998. as viewed on Apr. 18, 2009 at http://www3.interscience.wiley.com/journal/10003483/abstract?CRETRY=1&SRETR=0.*

International Search Report and Written Opinion dated Oct. 18, 2005 for PCT/IB2005/001263.

C. Nawrath et al., "Targeting of the polyhydroxybutyrate biosynthetic pathway to the plastids of *Arabidopsis thaliana* results in high levels of polymer accumulation", *Proc. Natl. Acad. Sci. USA*, vol. 91, pp. 12760-12764, Dec. 1994.

R. A. Andersen et al., "Optimum Conditions for Bonding of Plant Phenols to Insoluble Polyvinylpyrrolidone", *Phytochem*., 1968, vol. 7, pp. 293-301.

R. A. Andersen et al., "Estimation of Total Tobacco Plant Phenols by Their Bonding To Polyvinylpyrrolidone", *Tob. Sci. XII*, 1968, pp. 107-111.

International Preliminary Report on Patentability dated Oct. 19, 2006 for PCT/IB2005/001263.

* cited by examiner

REDUCTION OF PHENOLIC COMPOUND PRECURSORS IN TOBACCO

CROSS REFERENCE TO RELATED APPLICATIONS

This application claims priority under 35 U.S.C. §119(e) to U.S. Provisional Application No. 60/561,885 entitled Reduction of Phenolic Compounds in Tobacco and filed on Apr. 14, 2004, the entire content of which is hereby incorporated by reference.

BACKGROUND

In the description that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art.

Tobacco processing is disclosed in U.S. Pat. Nos. 5,601,097; 5,360,022; 5,311,886; 4,887,618 and 4,407,307. The removal of phenolic compounds from tobacco is disclosed in U.S. Pat. Nos. 6,789,548; 6,782,891; 6,298,859; 5,601,097; 5,601,097; 4,200,113; 3,561,451 and in U.S. Patent Application Publication Nos. 2003/0150011 and 2003/0106562.

SUMMARY

Provided is a tobacco rod comprising treated tobacco having reduced levels of at least one phenolic compound precursor compared to untreated tobacco. The at least one phenolic compound precursor can be gentisic acid, 3,4-dihydroxybenzoic acid, chlorogenic acid, rutin, scopoletin, quinic acid, quinic acid derivatives (e.g., p-coumaryl quinic acid, feruloyl quinic acid, and syringoyl quinic acid), caffeic acid, inositol or lignin. These phenolic compound precursors, which are water-soluble polyphenols, can lead to the formation of phenolic compounds during the combustion of tobacco. The concentration in mainstream smoke of phenolic compounds such as phenol, resorcinol, hydroquinones (e.g., hydroquinone, methyl hydroquinone and 2,3-dimethyl hydroquinone), catechols (e.g., catechol, 3-methylcatechol, 4-methylcatechol, dimethylcatechol and ethyl catechol) and cresols (e.g., o-cresol, m-cresol and p-cresol) can be reduced by reducing the concentration in uncured (e.g., green) or cured tobacco of the phenolic compound precursors.

A method of reducing the concentration of at least one phenolic compound precursor in tobacco using cold solvent or hot solvent extraction comprises (i) forming an extract of tobacco from cured or uncured tobacco by treating the tobacco with an aqueous solvent; (ii) removing at least one phenolic compound precursor from the extract by treating the extract with polyvinylpolypyrrolidone or polyvinylimidazole in the absence of an enzyme to form a treated extract; and (iii) restoring the treated extract to the cured or uncured tobacco. Optionally, the treated extract can be freeze-dried and/or concentrated prior to restoring the treated extract to the tobacco.

The polyvinylpolypyrrolidone or polyvinylimidazole can be in the form of a powder, which can be removed from the extract after treating by sedimentation, filtration and/or centrifugation. The method may further involve curing the uncured tobacco and adding the cured tobacco to a tobacco rod. Also provided is a smoking article comprising tobacco treated so as to produce reduced levels of phenolic compounds upon smoking thereof. According to an embodiment, the concentration in the extract of at least one phenolic compound precursor is reduced by at least 70% by weight. According to a further embodiment, the concentration of at least one tobacco-specific nitrosamine in mainstream smoke is reduced by at least 10% by weight.

A method for reducing the cytotoxicity of mainstream smoke from treated tobacco comprises treating tobacco with an aqueous solvent to form a tobacco extract, treating the tobacco extract with polyvinylpolypyrrolidone or polyvinylimidazole in the absence of an enzyme to form a treated extract; and restoring the treated extract to the tobacco to form treated tobacco.

DETAILED DESCRIPTION OF PREFERRED EMBODIMENTS

Figure 1:
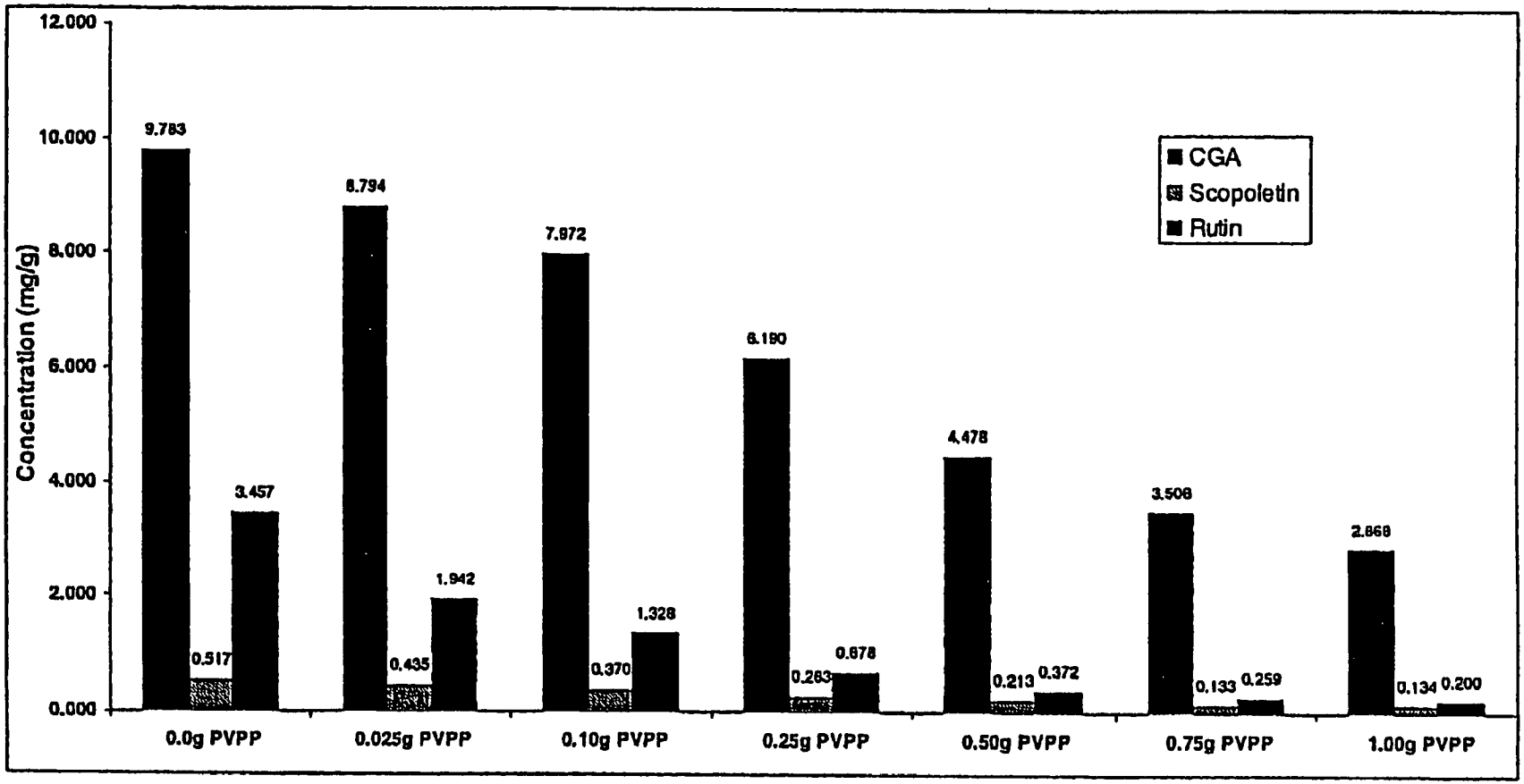
FIG. 1 shows the reduction in phenolic compound precursors (water soluble polyphenols) in a tobacco extract derived from cured tobacco that was treated with polyvinylpolypyrrolidone.

Tobacco having reduced levels of phenolic compound precursors such as gentisic acid, 3,4-dihydroxybenzoic acid, chlorogenic acid, rutin, scopoletin, caffeic acid, quinic acid, quinic acid derivatives, inositol and lignin are disclosed. Also disclosed are methods of processing tobacco to reduce the level of phenolic compound precursors in the tobacco. Such methods include cold water or hot water extraction of one or more precursor compounds that may lead to the formation of phenolic compounds.

Phenolic compounds such as phenol, hydroquinone, catechol and cresol can be formed by thermal degradation of gentisic acid, 3,4-dihydroxybenzoic acid, chlorogenic acid, rutin, scopoletin, quinic acid, quinic acid derivatives (e.g., p-coumaryl quinic acid, feruloyl quinic acid, and syringoyl quinic acid), caffeic acid, inositol and/or lignin, which are naturally occurring in tobacco. Thus, during the combustion of tobacco (e.g., during the smoking of a cigarette) phenol, hydroquinone, catechol and/or cresol can be formed in the mainstream smoke of a cigarette. In particular, phenol, hydroquinone, catechol and/or cresol can be formed at combustion temperatures of about 350° C. (e.g., between about 300 and 400° C.).

"Mainstream" smoke refers to the mixture of gases and/or aerosol passing down a tobacco rod and issuing through the filter end, i.e., the amount of smoke issuing or drawn from the mouth end of a cigarette during smoking of the cigarette. The mainstream smoke contains smoke that is drawn in through both the lighted region, as well as through the cigarette paper wrapper.

The concentration of phenolic compounds in mainstream smoke can be reduced by removing from cured or uncured tobacco the naturally-occurring precursors that can form phenolic compounds upon combustion of the tobacco. According to an embodiment, cured or uncured tobacco is processed using cold water or hot water extraction to reduce the concentration in the tobacco of one or more phenolic compound precursors that can form phenolic compounds during the smoking of a cigarette. A method for reducing the concentration of at least one phenolic compound precursor in tobacco using cold solvent or hot solvent extraction comprises (i) forming an extract of tobacco from uncured or cured tobacco by treating the tobacco with an aqueous solvent; (ii) removing at least one phenolic compound precursor from the extract by treating the extract with polyvinylpolypyrrolidone (PVPP) or polyvinylimidazole (PVI) in the absence of an enzyme to form a treated extract; and (iii) restoring the treated extract to the tobacco.

Polyvinylpolypyrrolidone or polyvinylimidazole are polymers that can adsorb phenolic compound precursors from a liquid extract derived from cured or uncured tobacco. After removing these compounds from the extract, the extract can be recombined with tobacco solids to from a treated tobacco product.

Uncured tobacco fibers that have been treated can be cured and processed into smoking articles such as cigarettes. Cured tobacco fibers that have been treated can processed into smoking articles such as cigarettes. In either case, the treated tobacco is similar in appearance, texture and processability as the original tobacco, but with substantially reduced levels of precursor compounds that produce phenolic compounds upon combustion of the tobacco. The reduction of phenolic compound precursors in the tobacco material provides for improved smokability and a reduction in phenolic products emitted from cigarettes that contain the treated tobacco material compared to untreated tobacco.

Examples of suitable types of tobacco materials include flue cured, Bright, Burley, Maryland or Oriental tobaccos, rare or specialty tobaccos, and blends thereof. The tobacco can be provided in the form of tobacco lamina; processed tobacco materials such as volume expanded or puffed tobacco, processed tobacco stems such as cut rolled or cut puffed stems, reconstituted tobacco materials; or blends thereof.

A liquid abstract of tobacco material, which can be in the form of whole leaf, stems, fines, lamina and/or scraps, can be obtained by contacting the tobacco with an aqueous solvent in the absence of an enzyme. The tobacco material can be contacted with the aqueous solvent in one or more steps to obtain an aqueous liquid extract.

Preferably, the liquid extract is separated from the tobacco fiber (e.g., tobacco solids) by filtration or centrifugation and then the extract contacted with an adsorbent such as polyvinylpolypyrrolidone or polyvinylimidazole. Polyvinylpolypyrrolidone and polyvinylimidazole can adsorb phenolic compound precursors present in the liquid extract via the formation of hydrogen bonds with the compounds.

After treating the liquid extract with the adsorbent, the adsorbent can be separated from the extract and the treated extract can be recombined with the tobacco solids to form treated tobacco. The treated extract may optionally be concentrated before it is added back to the tobacco. By way of example, the liquid extract can be freeze-dried and later reconstituted with water to form a concentrated, treated extract. The PVPP-treated (or PVI-treated) liquid extract, which can be in an unconcentrated, but preferably a concentrated form, can be sprayed onto tobacco fibers during or after drying of the tobacco fibers.

The aqueous solvent used to extract the phenolic compound precursors is preferably water, although mixtures of water and other organic solvents may be used. A preferred aqueous solvent comprises more than about 95 wt. % water, most preferably greater than about 99 wt. % water (e.g., 100% water). Preferably the temperature of the solvent during both the extraction and the contacting of the extract with the polyvinylpolypyrrolidone or polyvinylimidazole is between about 0 and 65° C. (e.g., a temperature of at least 5, 10, 20, 35 or 45° C.), though high-temperature extraction can be used, wherein the temperature of the solvent during the extraction is greater than 65° C. (e.g., at least 70, 75, 80 or 85° C.). Cold solvent extraction refers to a process using an extraction solvent comprising water and having a temperature of from about 0 to 65° C., and hot solvent extraction refers to a process using an extraction solvent comprising water and having a temperature of from about 65 to 100° C.

In addition to water, the aqueous solvent mixture may comprise alcohols or other water miscible solvents such as methanol, ethanol, 1-propanol, 2-propanol, 1-butanol, 2-butanol, isobutanol, tert-butanol, acetone, ethyleneglycol dimethyl ether, ethyleneglycol monomethyl ether, tetrahydrofuran, 1,4-dioxane, morpholine, dimethylformamide, diethylene glycol, dimethyl ether, dimethyl sulfoxide, diethylene glycol monomethyl ether, ethyleneglycol, diethyleneglycol, sulpholane, glycerol and/or triethanolamine. Thus, in either a hot solvent or a cold solvent extraction process, the extraction solvent preferably comprises an aqueous solvent mixture. The aqueous solvent is preferably free of enzymatic compounds.

The amount of solvent used to form the liquid extract can be any amount effective to form an extract comprising phenolic compound precursors. According to an embodiment, the mass ratio of solvent to tobacco during the extraction is greater than 10 (e.g., greater than 15 or greater than 20).

Polyvinylpolypyrrolidone- and polyvinylimidazole-containing polymers are marketed by BASF under the tradename DIVERGAN®. For example, DIVERGAN®-RS is a cross-linked polyvinylpolypyrrolidone powder having a mean particle size of about 200 microns, a density of about 1.2 g/cm$^3$ and a melting (decomposition) point of about 220° C. DIVERGAN®-HM is a powdered cross-linked co-polymer consisting of n-vinylimidizole and n-vinylpyrrolidone. Both polyvinylpolypyrrolidone and polyvinylimidazole are substantially insoluble in both polar and non-polar solvents. As such, they can be separated from liquid solutions using techniques such as filtration, decantation, centrifugation, etc.

Two different DIVERGAN® products (DIVERGAN®-RS and DIVERGAN®-HM) were tested separately on both standard solutions comprising different water-soluble polyphenols and on extracts derived from Bright or Burley tobaccos.

In standard solutions comprising different water-soluble polyphenols, DIVERGAN®-RS and DIVERGAN®-NM each substantially decrease the concentration of quinic acid, chlorogenic acid (CGA), gentisic acid (GA), caffeic acid (CA), rutin and scopoletin as measured by either high performance liquid chromatography (HPLC) or by liquid chromatography/mass spectrometry (LC/MS). Results from test solutions, expressed as a percent reduction in concentration, are shown in Table 1. Relative to a control sample, the Table 1 data show that DIVERGAN®-RS and DIVERGAN®-HM can reduce the concentration in a test solution of each of quinic acid, chlorogenic acid, gentisic acid, caffeic acid, rutin and scopoletin by at least 89% and 93%, respectively.

TABLE 1

| | | Percent reduction in phenolic compound precursors in standard solutions | | | | | |
|---|---|---|---|---|---|---|---|
| Measurement | DIVERGAN ® type | Quinic | CGA | GA | CA | Rutin | Scopoletin |
| HPLC | RS | N/A | 95.6 | 97.0 | 98.7 | 100.0 | 89.3 |
| | HM | N/A | 100.0 | 100.0 | 100.0 | 100.0 | 92.6 |
| LC/MS | RS | 93.4 | 98.3 | 97.8 | 99.5 | 99.7 | 96.4 |
| | HM | 98.0 | 100.0 | 100.0 | 100.0 | 100.0 | 96.8 |

N/A = data not taken.

The reduction in concentration (based on HPLC analysis) in test solutions of phenolic compounds by adsorption with DIVERGAN®-RS or DIVERGAN®-HM is shown in Table 2. Relative to a control sample, the Table 2 data show that DIVERGAN®-RS and DIVERGAN®-HM can reduce the test solution concentration of each of hydroquinone (HQ), resorcinol, methyl hydroquinone (MHQ), catechol, phenol, 4-methylcatechol (4-MC) and 3-methylcatechol (3-MC) by a minimum of about 67% and 65%, respectively.

TABLE 2

Percent reduction in phenolic compounds in standard solutions

| DIVERGAN ® type | HQ | resorcinol | MHQ | catechol | phenol | 4-MC | 3-MC |
|---|---|---|---|---|---|---|---|
| RS | 86.9 | 92.2 | 89.8 | 77.1 | 67.1 | 80.4 | 79.1 |
| HM | 87.3 | 94.3 | 94.0 | 84.9 | 65.0 | 86.8 | 84.7 |

Typically, the efficacy of the adsorption is a function of the solution temperature and pH, exposure time, concentration of phenolic compound precursor(s) in the solution and/or the amount of adsorbent used, as well as, due to steric effects, the chemical structure of the phenolic compound precursor(s).

FIG. 1 shows the reduction in concentration of selected phenolic compound precursors in tobacco extract as a function of the amount of polyvinylpolypyrrolidone (PVPP) added to the extract. The tobacco extract was prepared by combining samples of cured tobacco (0.5 g) with 10 ml of deionized water at room temperature to form a slurry and then filtering the slurry to form the extract. A known mass of PVPP was added to the extract, shaken for 1 hr., centrifuged at about 3000 rpm for 15 minutes, and then decanted and filtered through a 0.45 micron filter. The concentration of phenolic compound precursors remaining in the extract after removing the PVPP from the extract was measured by HPLC. As shown in FIG. 1, the concentration of chlorogenic acid (CGA), scopoletin and rutin decreases for larger amounts of PVPP added to the extract. For example, the concentration of chlorogenic acid is decreased by more than 70% and the concentration of rutin is decreased by more than 90% by adding about 1 g of PVPP to the extract.

The reduction in concentration of chlorogenic acid, scopoletin and rutin in Bright and Burley tobacco extracts treated with PVPP is shown in Table 3. The Bright tobacco extract reported in Table 3 was freeze-dried after treatment with PVPP and reconstituted with water to give an extract concentration higher than that of the original extract. As shown by the results in Table 3, the total reduction in chlorogenic acid, scopoletin and rutin in the Bright tobacco extract is greater than 80%, and the total reduction in chlorogenic acid, scopoletin and rutin in the Burley tobacco extract is greater than 90%. In Table 3, the concentrations of the phenolic compound precursors are given in micromoles/gram

TABLE 3

Reduction in chlorogenic acid, scopoletin and rutin in Bright and Burley extracts

| | CGA | Scopoletin | Rutin | Total |
|---|---|---|---|---|
| Bright extract | 29.3 | 0.3 | 10.2 | 39.8 |
| PVPP treated Bright extract | 6.3 | 0.0 | 0.5 | 6.9 |
| % Reduction | 78% | 87% | 95% | 83% |
| Burley extract | 0.2 | 0.04 | 0.27 | 0.5 |
| PVPP treated Burley extract | 0.04 | 0.0 | 0.0 | 0.04 |
| % Reduction | 78% | 100% | 100% | 92% |

Tables 4-6 show the effect of PVPP extraction on the concentration in tobacco extracts of select non-phenolic compounds. The data in Tables 4-6 show the concentration of select inorganic salts (Table 4); minor alkaloids (Table 5); and tobacco-specific nitrosamines, TSNAs, (Table 6) for i) Bright cut filler (control sample); ii) water-extracted Bright cut filler after reconstitution with water solubles, and iii) water-extracted Bright cut filler after reconstitution with water solubles that were treated with PVPP. In Table 6, the following TSNA abbreviations are used: N'-nitrosonornicotine [NNN]; 4-(N-methyl-N-nitrosamino)-1-(3-pyridyl-1-butanone) [NNK]; N'-nitrosoanatabine [NAT]; and N'-nitrosoanabasine [NAB]. As shown by the data in Table 4-5, PVPP extraction has a minimal effect on the concentration of calcium, magnesium and potassium and on minor alkaloids in the tobacco extracts. As shown by the data in Table 6, the PVPP extraction can reduce the concentration in mainstream smoke of tobacco-specific nitrosamines by at least about 10%. For example, PVPP extraction reduces the concentration of TSNAs in the extract by about 12 to 15%.

TABLE 4

Effect of PVPP extraction on inorganic salt concentrations (%)

| Sample | Calcium | Magnesium | Potassium |
|---|---|---|---|
| Bright Cut Filler | 2.0 | 0.71 | 3.1 |
| Reconstituted Cut Filler | 2.0 | 0.68 | 3.1 |
| Cut Filler Reconstituted with PVPP-treated solubles | 1.9 | 0.68 | 3.1 |

TABLE 5

Effect of PVPP extraction on minor alkaloid concentrations (%)

| Sample | Nicotine | Nornicotine | Anabasine | Anatabine | Myosmine |
|---|---|---|---|---|---|
| Bright Cut Filler | 2.9 | 0.07 | 0.01 | 0.1 | 0.01 |
| Reconstituted Cut Filler | 2.8 | 0.07 | 0.01 | 0.1 | 0.01 |
| Cut Filler Reconstituted with PVPP-treated solubles | 2.8 | 0.08 | 0.01 | 0.1 | 0.01 |

TABLE 6

Effect of PVPP extraction on TSNA concentrations (ng/g)

| Sample | NNN | NNK | NAB | NAT |
|---|---|---|---|---|
| Bright Cut Filler | 1990 | 2880 | 183 | 2420 |
| Reconstituted Cut Filler | 1960 | 2880 | 173 | 2300 |
| Cut Filler Reconstituted with PVPP-treated solubles | 1750 | 2490 | 158 | 2050 |

The three different tobacco samples used to produce the data reported in Tables 4-6 were used to form test cigarettes. Smoke from the test cigarettes was analyzed for selected phenolic compounds. The concentration (ng/cigarette) of phenolic compounds in cigarette smoke for cigarettes comprising i) Bright cut filler; ii) water-extracted Bright cut filler after reconstitution with water solubles, and iii) water-extracted Bright cut filler after reconstitution with water solubles that were treated with PVPP are shown in Table 7.

Cold or hot water extraction of tobacco lamina to remove phenolic compound precursors can reduce the yield upon combustion of the tobacco of phenol, hydroquinone and/or catechol by greater than 25% (e.g., greater than 30%, 50% or 80%) compared to untreated tobacco. In Table 7, B[a]A stands for benzo(a)anthracene; and B[a]P stands for benzo(a) pyrene. The units of concentration for B[a]A and B[a]P are nanograms/cigarette, and the units of concentration for resorcinol, catechol, phenol and hydroquinone are micrograms/cigarette.

TABLE 7

Effect of PVPP extraction on cigarette smoke (per cigarette)

| Sample | B[a]A | B[a]P | Resorcinol | Catechol | Phenol | Hydroquinone |
|---|---|---|---|---|---|---|
| Cut Filler | 26 | 15 | 3.3 | 130 | 61 | 120 |
| Reconstituted Cut Filler | 17 | 9.6 | 2.3 | 91 | 44 | 71 |
| Cut Filler Reconstituted with PVPP-treated solubles | 21 | 11 | 2.0 | 73 | 38 | 59 |

The data in Table 7, which shows the concentration in smoke per cigarette, is re-plotted in Table 8 as the concentration per total particulate matter (TPM) or tar. In Table 8, the units of concentration for B[a]A and B[a]P are nanograms per milligram of total particulate matter, and the units of concentration for resorcinol, catechol, phenol and hydroquinone are micrograms per milligram of total particulate matter.

TABLE 8

Effect of PVPP extraction on cigarette smoke (per total particulate matter)

| Sample | B[a]A | B[a]P | Resorcinol | Catechol | Phenol | Hydroquinone |
|---|---|---|---|---|---|---|
| Cut Filler | 0.9 | 0.6 | 0.1 | 4.1 | 1.9 | 3.8 |
| Reconstituted Cut Filler | 0.7 | 0.6 | 0.1 | 3.7 | 1.8 | 2.9 |
| Cut Filler Reconstituted with PVPP-treated solubles | 0.8 | 0.5 | 0.1 | 2.9 | 1.5 | 2.3 |

The biological activity (cytotoxicity and mutagenicity) was evaluated for i) Bright cut filler; ii) water-extracted Bright cut filler after reconstitution with water solubles, and iii) water-extracted Bright cut filler after reconstitution with water solubles that were treated with PVPP.

Cytotoxicity was measured using the neutral red dye cytotoxicity assay. The neutral red cytotoxicity assay procedure is a cell survival/viability chemosensitivity assay, based on the ability of viable cells to incorporate and bind neutral red, which is a supravital dye. Neutral red is a weak cationic dye that can penetrate cell membranes by non-ionic diffusion and accumulate therein. Alterations of the cell surface or of lysosomal membranes can lead to lysosomal fragility and other changes that gradually become irreversible. Such changes brought about by the action of xenobiotics may result in a decreased uptake and binding of neutral red. It is thus possible to distinguish between viable, damaged, or dead cells, which is the basis of this assay.

Mutagenicity was measured using the standard Ames test. The Ames test is a biological method for measuring the mutagenic potency of chemical substances. The Ames method is based on inducing growth in genetically altered strains of a particular bacterium.

Table 9 shows the results for cytotoxicity and mutagenicity. The data show that treatment of Bright tobacco extract with PVPP decreases cytotoxicity by more than 35% and, when accounting for statistical deviations, is substantially neutral with respect to mutagenicity. Without wishing to be bound by theory, the treatment of tobacco extracts with PVPP and/or PVI is believed to reduce the concentration in the extract of precursors that can contribute to cytotoxicity upon pyrolysis or thermal degradation of the tobacco. Thus, mainstream smoke from smoking articles made using treated tobacco can have reduced levels of cytotoxicity compared to smoking articles made using untreated tobacco.

TABLE 9

Biological activity of PVPP-treated Bright tobacco

| Sample | Cytotoxicity (ml/mg) | Mutagenicity (revertants/mg) |
|---|---|---|
| Cut Filler | 8.4 | 1439 |
| Reconstituted Cut Filler | 8.0 | 1142 |
| Cut Filler Reconstituted with PVPP-treated solubles | 5.4 | 1278 |

As disclosed above, PVPP (or PVI) can be used to reduce the concentration of phenolic compound precursors in tobacco extracts, and the treated tobacco extracts can be recombined with tobacco solids to produce a treated tobacco that can be incorporated into a cigarette.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

All of the above-mentioned references are herein incorporated by reference in their entirety to the same extent as if each individual reference was specifically and individually indicated to be incorporated herein by reference in its entirety.

We claim:

1. A method of reducing the concentration of at least one phenolic compound precursor in tobacco using cold solvent or hot solvent extraction comprising:

forming an extract of tobacco from uncured or cured tobacco by treating the tobacco with an aqueous solvent;

removing the at least one phenolic compound precursor from the extract by treating the extract with polyvinylimidazole in the absence of an enzyme to form a treated extract; and restoring the treated extract to the tobacco.

2. The method of claim 1, wherein the polyvinylimidazole comprises a powder.

3. The method of claim 1, comprising removing the polyvinylimidazole from the treated extract by sedimentation, filtration or centrifugation.

4. The method of claim 1, wherein the temperature of the solvent during the extraction is between about 0 and 65° C.

5. A method of reducing the concentration of at least one phenolic compound precursor in tobacco using cold solvent or hot solvent extraction comprising:

forming an extract of tobacco from uncured or cured tobacco by treating the tobacco with an aqueous solvent;

removing the at least one phenolic compound precursor from the extract by treating the extract with polyvinylimidazole in the absence of an enzyme to form a treated extract; and restoring the treated extract to the tobacco, wherein the temperature of the solvent during the extraction is greater than 75° C.

6. The method of claim 1, wherein the mass ratio of solvent to tobacco during the extraction is greater than 10.

7. The method of claim 1, further comprising freeze-drying the treated extract prior to restoring the treated extract to the tobacco.

8. The method of claim 1, further comprising concentrating the treated extract prior to restoring the treated extract to the tobacco.

9. The method of claim 1, wherein the at least one phenolic compound precursor is selected from the group consisting of gentisic acid, 3,4-dihydroxybenzoic acid, chlorogenic acid, rutin, scopoletin, caffeic acid, inositol, quinic acid, a quinic acid derivative and lignin.

10. The method of claim 1, further comprising curing the uncured tobacco.

11. The method of claim 10, further comprising adding the cured tobacco to a tobacco rod.

12. A method of reducing the concentration of at least one phenolic compound precursor in tobacco using cold solvent or hot solvent extraction comprising:

forming an extract of tobacco from uncured or cured tobacco by treating the tobacco with an aqueous solvent;

removing the at least one phenolic compound precursor from the extract by treating the extract with polyvinylimidazole in the absence of an enzyme to form a treated extract; and restoring the treated extract to the tobacco wherein the tobacco comprising the treated extract provides a reduced amount of a phenolic compound selected from the group consisting of hydroquinone, catechol, and cresol when combusted.

13. The method of claim 1, wherein the concentration of the at least one phenolic compound precursor is reduced by at least 70% by weight.

14. The method of claim 1, further reducing the concentration of at least one tobacco-specific nitrosamine in mainstream smoke by at least 10% by weight.

* * * * *